US006631728B2

(12) United States Patent
Liu

(10) Patent No.: US 6,631,728 B2
(45) Date of Patent: Oct. 14, 2003

(54) ADORNMENT FOR CRANK

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/908,579

(22) Filed: Jul. 20, 2001

(65) Prior Publication Data

US 2003/0015228 A1 Jan. 23, 2003

(51) Int. Cl.[7] ..... A45B 25/00
(52) U.S. Cl. ..... 135/20.3
(58) Field of Search ..... 135/20.3, 16; 242/395, 242/395.1, 396.9; D3/10

(56) References Cited

U.S. PATENT DOCUMENTS 3,142,307 A * 7/1964 Danciart et al. ..... 135/20.3
4,622,987 A * 11/1986 Redl et al. ..... 135/20.3
5,437,297 A * 8/1995 Crisman et al. ..... 135/20.1
5,884,859 A * 3/1999 Ma ..... 135/20.3
D411,655 S * 6/1999 Tung ..... D3/10
6,182,917 B1 * 2/2001 Lai ..... 135/20.3
6,196,489 B1 * 3/2001 Ma ..... 135/20.3

* cited by examiner

*Primary Examiner*—Janet M. Wilkens
(74) *Attorney, Agent, or Firm*—Birch, Stewart, Kolasch & Birch, LLP

(57) ABSTRACT

An adornment for mounting a crank which is to control extension and folding of an umbrella includes a first shell located between the umbrella shaft and a crank arm of the crank, and a second shell encasing another side of the umbrella shaft and matching and engageable with the first shell. The first and second shell have respectively a matching symmetrical first coupling section and a second coupling section to engage with a matching first fastening cap and a second fastening cap movable on the umbrella shaft for a selected displacement to form a completed adornment for the crank.

5 Claims, 4 Drawing Sheets

PRIOR ART Fig. 1

ADORNMENT FOR CRANK

BACKGROUND OF THE INVENTION

The present invention relates to an adornment for cranks and particularly an adornment adaptable flexibly to various shapes for creating versatile decorating effect.

In order to make the umbrellas more appealing and attractive, many umbrellas have an adornment or ornamental article for mounting a crank on the umbrella shaft to control the extension and folding of the umbrella. FIG. 1 shows a conventional adornment for such purpose. It includes a first shell mounted on one side of the umbrella shaft for supporting the crank and a second shell located at another side of the umbrella shaft to match the first shell. The crank has a crank shaft passing through the first shell and umbrella shaft, and fastened at another end by a screw nut. The second shell is coupled and fastened to the first shell by screws. The construction set forth above has disadvantages, notably:

1. The adornment is aimed to cover the unsightly crank mechanism. However, the adornment itself and screw fastening of the shells often become an eyesore and spoil the appearance of the whole umbrella setting.
2. Fastening the first and second shell by screws not only spoils the appearance of the umbrella set, it also requires tools and additional assembly time and efforts. Moreover, the screws are made of metal while the shells are generally made of plastics. To fasten these two types of elements of different rigidity tends to cause rupturing or fracturing of the shells, especially screw threads, and may result in loose coupling of the shells. On the other hand, fastening the shells with too strong of force could result in the shells stuck together and cannot be separated unless disassembled by a destructive way. It is not a cost effective design and structure.

SUMMARY OF THE INVENTION

The primary object of the present invention is to resolve the foregoing disadvantages. The present invention provides an adornment that may be assembled easily without using any tool and offer an attractive appearance to increase appealing of the whole product. The adornment includes a first shell located between the umbrella shaft and a crank arm of a crank, and a second shell mounted on another side of the umbrella shaft to match and engage with the first shell. The first and second shell have respectively a first and a second coupling section located at both ends and symmetrical to each other. On the umbrella shaft, there are a first and a second fastening cap movable thereon to fasten respectively to the first and second coupling section to form the completed adornment.

The foregoing, as well as additional objects, features and advantages of the invention will be more readily apparent from the following detailed description, which proceeds with reference to the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
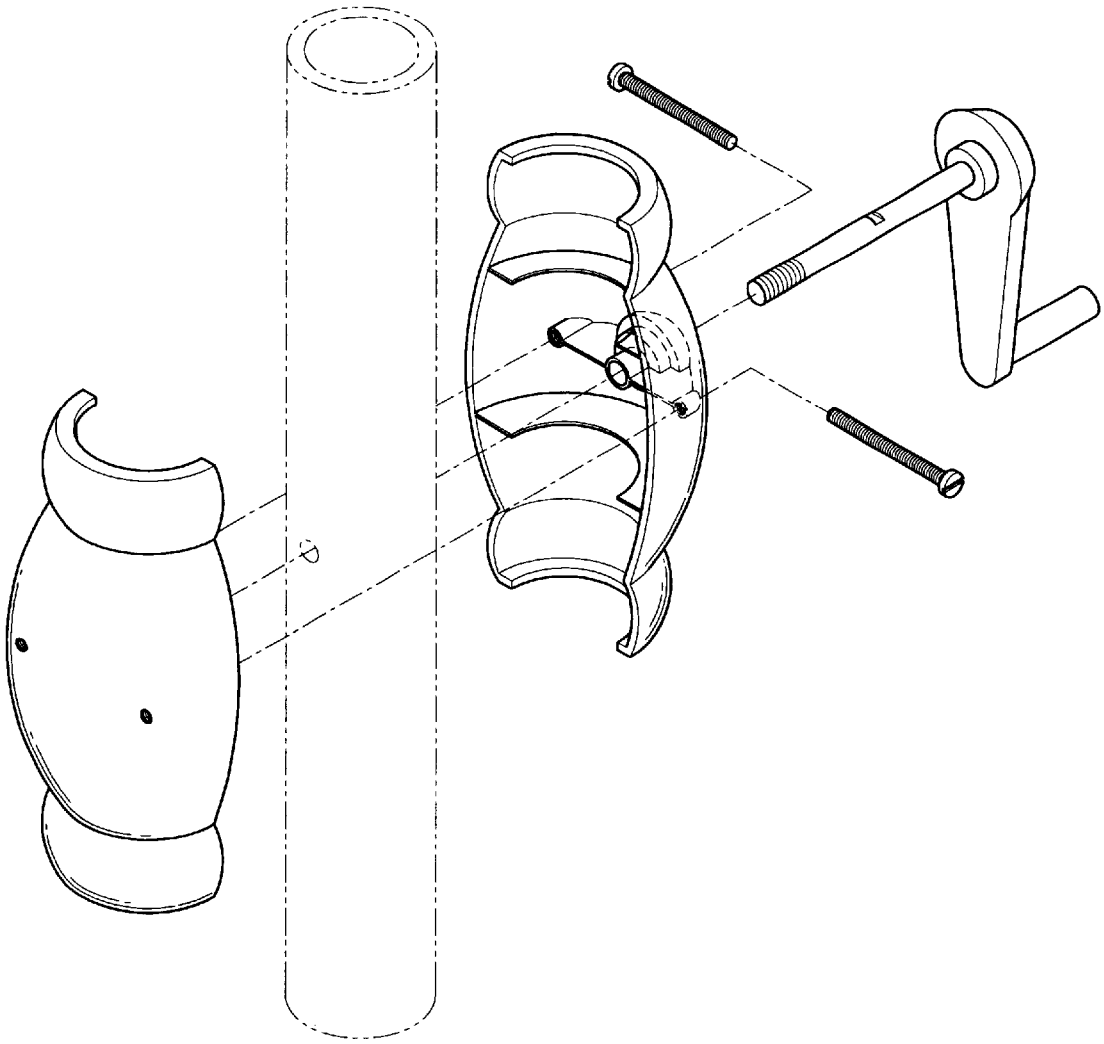
FIG. 1 is an exploded view of a conventional adornment for umbrella.
Figure 2:
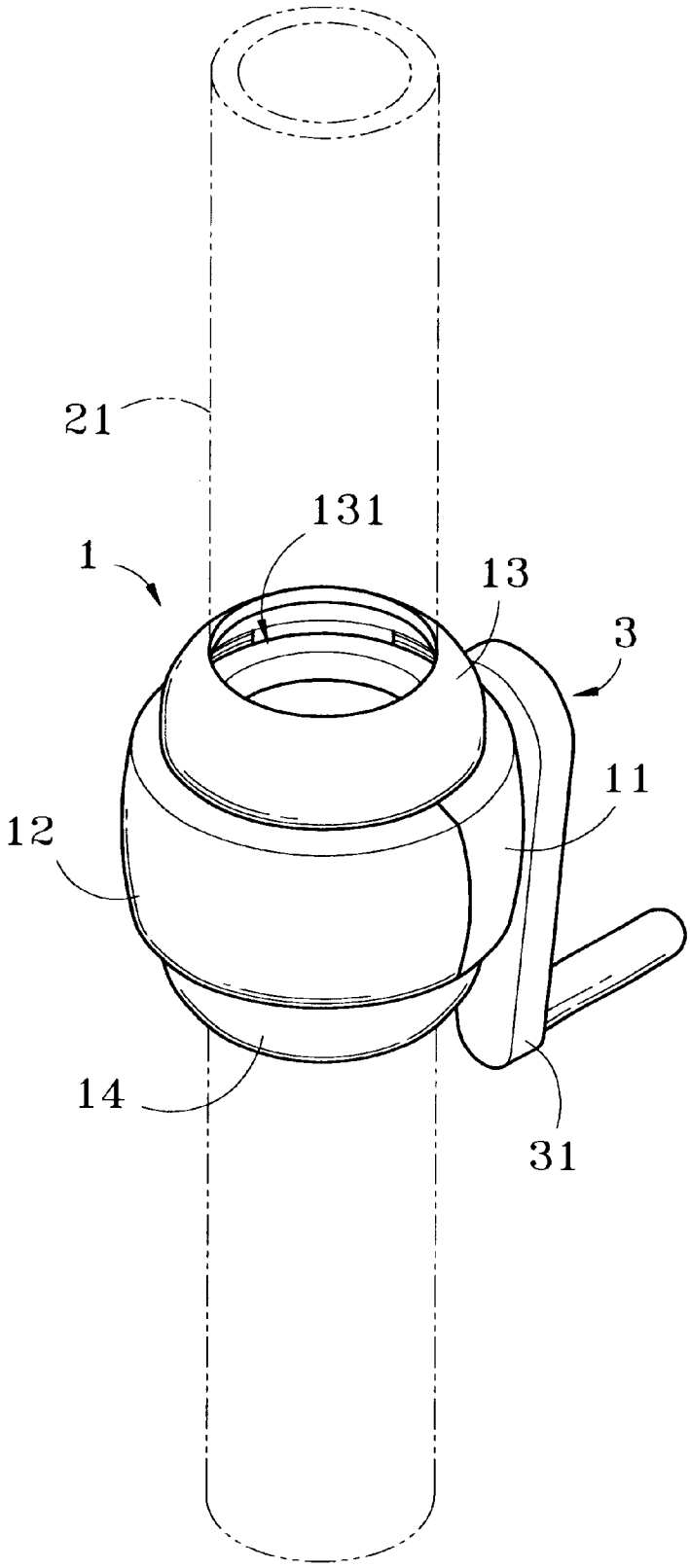
FIG. 2 is a perspective view of the invention.
Figure 3:
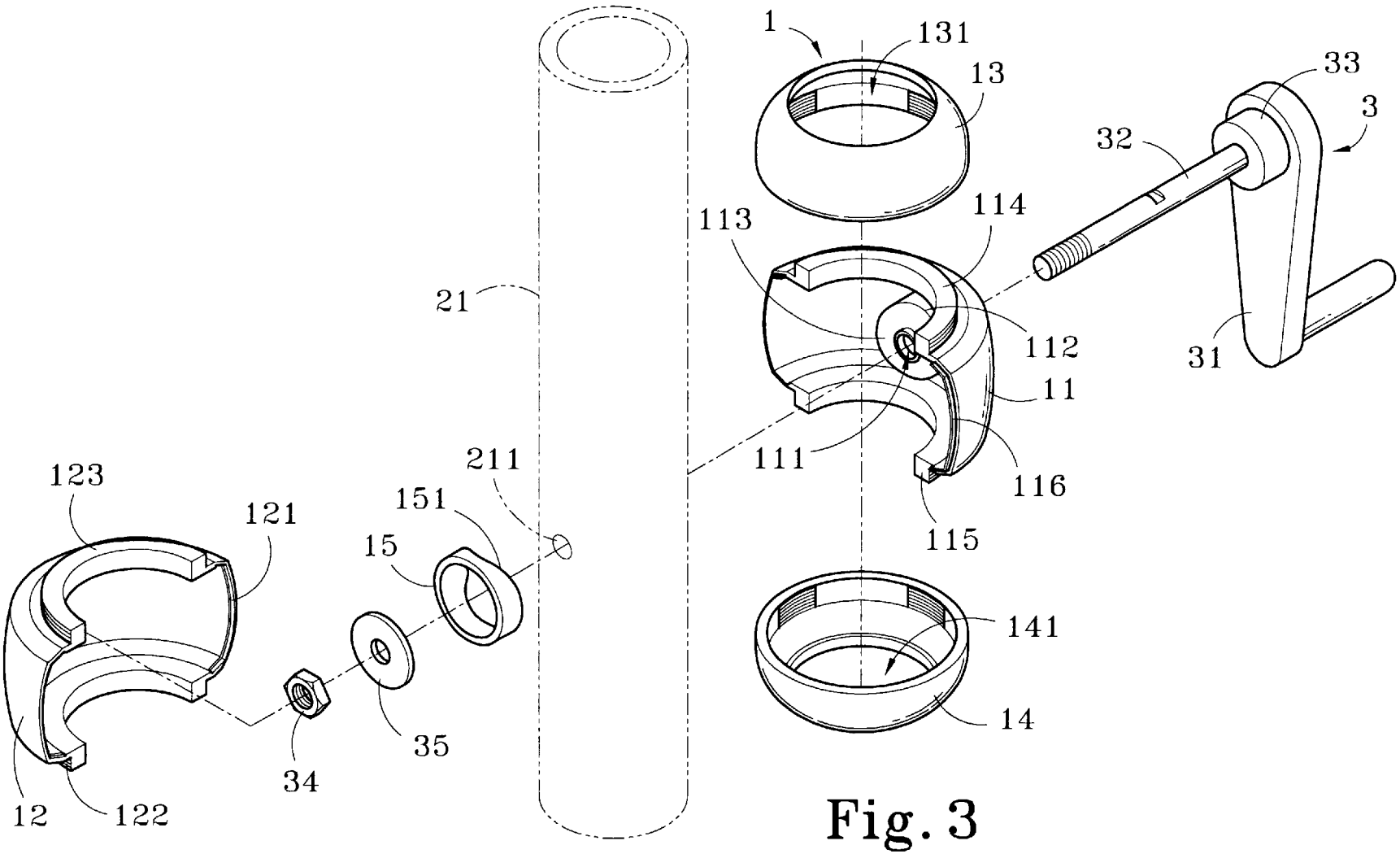
FIG. 3 is an exploded view of the invention according to FIG. 2.
Figure 4:
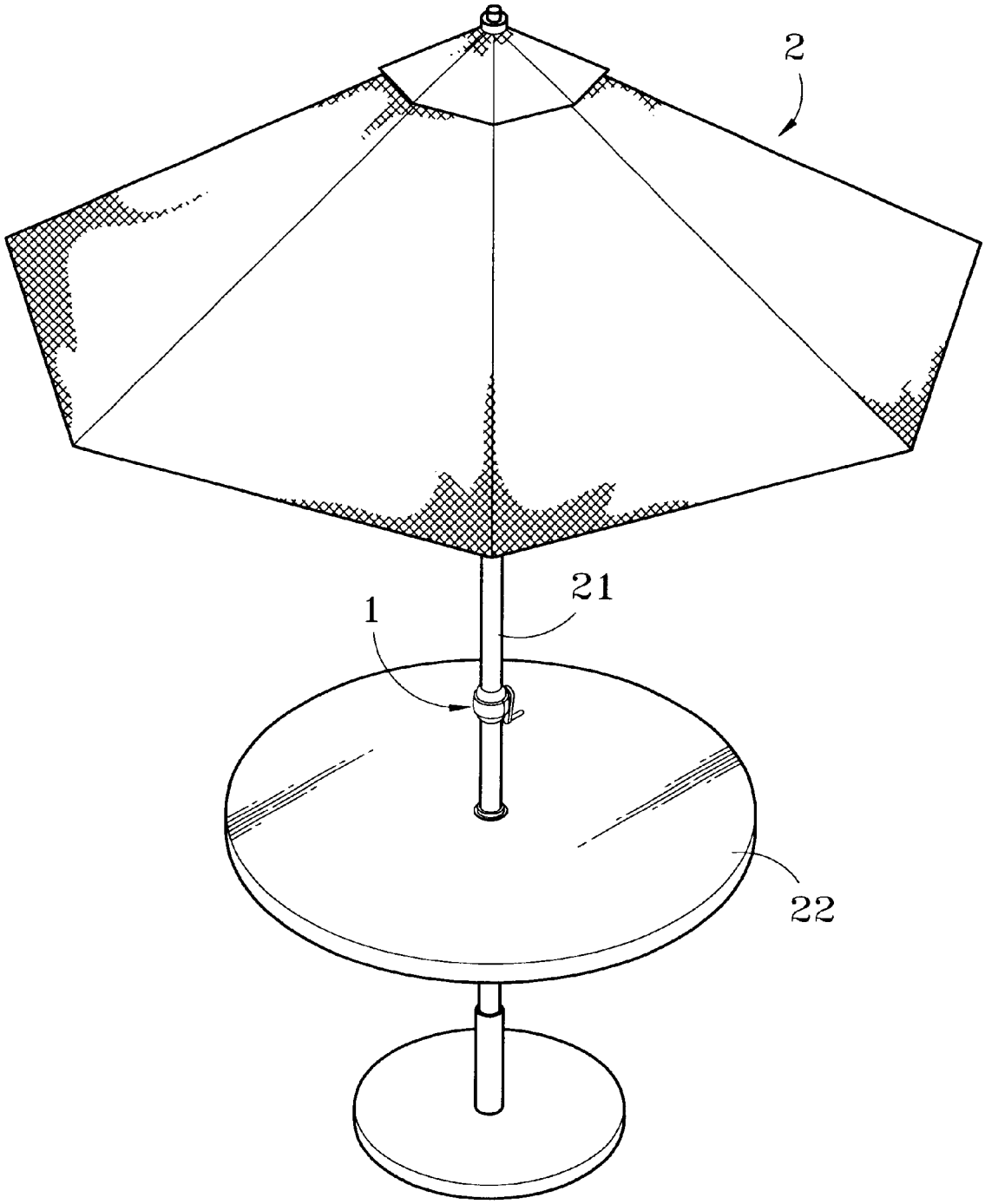
FIG. 4 is a schematic view of an embodiment of the invention.

Referring to FIGS. 2, 3 and 4, the present invention is to couple with a crank 3 which is used for controlling the extension and folding of the umbrella 2. The crank 3 includes a crank arm 31 and a crank shaft 32 attached to the crank arm 31. The crank shaft 31 passes through an adornment 1 and is fastened to the umbrella shaft 21 of the umbrella 2. The adornment 1 consists of a first shell 11 located between the umbrella shaft 21 and the crank arm 31, and a second shell 12 encasing another side of the umbrella shaft 21 and matching and engageable with the first shell 11. The first shell 11 has a first aperture 111 to allow the crank shaft 32 to pass through, and a first coupling section 114 and a second coupling section 115 formed at two ends. The second shell 12 also has a first coupling section 123 and a second coupling section 122 formed at two ends matching the first and second coupling section 114 and 115 of the first shell 11. On the umbrella shaft 21, there are a first and a second fastening cap 13 and 14 movable thereon for a selected displacement to fasten respectively to the first and second coupling section 114, 123, 115 and 122 to form the completed adornment 1 for decorating the crank 3.

The first and second fastening cap 13 and 14 have respectively an opening 131 and 141 which are slightly larger than the diameter of the umbrella shaft 21 to allow the fastening caps 13 and 14 movable on the umbrella shaft 21. The crank 3 has a step ring 33 formed at one end of the crank arm 31 to support the crank shaft 32 and to allow the crank arm 31 positioning snugly one side of the first shell 11. The first shell 11 has a neck section 112 around the first aperture 111 adjacent to the umbrella shaft 21. The neck section 112 has a cavity which has a depth and diameter slightly larger than the step ring 33 to accommodate the step ring 33 to allow the crank arm 31 functioning smoothly on the first shell 11. The neck section 112 also has a curved surface 113 at the front side to match and contact the peripheral surface of the umbrella shaft 21. The umbrella shaft 21 has a second aperture 211 matching the first aperture 111 to engage with the crank shaft 32. Hence the crank 3 may be mounted to the first shell 11 by inserting the crank shaft 32 through the first aperture 111 and second aperture 211 with the step ring 33 nestling in the neck section 112. The free end of the crank shaft 32 passes through the umbrella shaft 21 and engages with a washer 35 and a screw nut 34. There is a guarding ring 15 located between the washer 35 and the umbrella shaft 21. The guarding ring 15 has a curved rim 151 to match the peripheral surface of the umbrella shaft 21 to allow the crank shaft 32 fastened to the umbrella shaft 21 securely through the washer 35 and screw nut 34 without damaging the surface of the umbrella shaft 21.

After the crank 3 is fastened to the umbrella shaft 21 through the first shell 11 set forth above, couple the second shell 12 with the first shell 11. The first and second shell 11 and 12 have respectively a first and a second coupling edge 116 and 121 which are formed in a matching bulged rib and indented recess to allow first and second shell 11 and 12 forming a closed and snug coupling. The coupled first and second coupling section 114, 123 and 115, 122 have external screw threads, while the first and second fastening cap 13 and 14 have matching internal screw threads. Hence the first and second fastening cap 13 and 14 may be moved to engage with the first and second coupling section 114, 123 and 115, 122 to complete the assembly of the adornment 1.

As shown in the drawings, the first and second shell 11 and 12 may be formed respectively in a symmetrical semi-sphere shape, while the first and second fastening cap 13 and 14 may also be formed respectively in a symmetrical semi-sphere shape. Thus the completed assembly of the adornment 1 will have a smooth and streamline shape, and may match the table set 22 nicely and make total umbrella setting more appealing.

As can also be seen in the drawings, a height of the first fastening cap 13 and a height of the second fastening cap 14 are at least a fourth of a height of one of the first and second shells 11, 12.

While the preferred embodiment of the invention have been set forth for the purpose of disclosure, modifications of the disclosed embodiments of the invention as well as other embodiment thereof may occur to those skilled in the art. Accordingly, the appended claims are intended to cover all embodiments which do not depart from the spirit and scope of the invention.

What is claimed is:

1. An adornment for a crank which has a crank arm and a crank shaft attached to the crank arm passing through and mounting on an umbrella shaft for controlling extension and folding of an umbrella, comprising:

a first shell located between the umbrella shaft and the crank arm having a first aperture to allow the crank shaft to pass through and at least a first coupling section and a second coupling section located at two ends thereof;

a second shell encasing another side of the umbrella shaft and matching and engageable with the first shell, and having at least a first coupling section and a second coupling section located at two ends thereof symmetrical to the first coupling section and the second coupling section located on the first shell; and a first fastening cap and a second fastening cap movable on the umbrella shaft for a selected displacement matching and engageable respectively with the first coupling sections and the second coupling sections for forming the adornment to decorate the crank;

wherein the first aperture in the first shell is located in a midsection of the first shell, the first coupling section and the second coupling section of both the first shell and the second shell have external screw threads, and the first and second fastening caps have internal screw threads that mate with the external screw threads of the first and second shells, the first shell and the second shell have contact edges formed of a first coupling edge and a second coupling edge with the first coupling edge and the second coupling edge being matching bulged rib and indented recess, and a height of the first fastening cap is at least a fourth of a height of one of the first and second shells and wherein a height of the second fastening cap is at least a fourth of the one of the first and second shells.

2. The adornment for a crank of claim 1, wherein the first shell and the second shell are symmetrical semi-spheres.

3. The adornment for a crank of claim 1, wherein the first shell further has neck section surrounding the first aperture adjacent to the umbrella shaft.

4. The adornment for a crank of claim 3, wherein the neck section has a contact surface at the front side matching the umbrella shaft.

5. The adornment for a crank of claim 1, wherein the first and second shells are attached to each other by the first and second fastening caps.

* * * * *